US009719043B2

(12) United States Patent
Gieselman et al.

(10) Patent No.: US 9,719,043 B2
(45) **Date of Patent: *Aug. 1, 2017**

(54) LOW ASH LUBRICANTS WITH IMPROVED SEAL AND CORROSION PERFORMANCE

(71) Applicant: The Lubrizol Corporation, Wickliffe, OH (US)

(72) Inventors: Matthew D. Gieselman, Wickliffe, OH (US); Mary Galic Raguz, Mentor, OH (US); John G. Loop, Perry, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/213,987

(22) Filed: Jul. 19, 2016

(65) Prior Publication Data

US 2016/0326454 A1 Nov. 10, 2016

Related U.S. Application Data

(63) Continuation of application No. 13/698,144, filed as application No. PCT/US2011/036776 on May 17, 2011, now Pat. No. 9,399,747.

(60) Provisional application No. 61/346,497, filed on May 20, 2010.

(51) Int. Cl.

| | |
|---|---|
| ***C10M 165/00*** | (2006.01) |
| ***C10M 163/00*** | (2006.01) |
| ***C10M 161/00*** | (2006.01) |
| *C10M 135/10* | (2006.01) |
| *C10M 149/16* | (2006.01) |

(52) U.S. Cl.

CPC ..... *C10M 165/00* (2013.01); *C10M 161/00* (2013.01); *C10M 163/00* (2013.01); *C10M 135/10* (2013.01); *C10M 149/16* (2013.01); *C10M 2205/00* (2013.01); *C10M 2207/023* (2013.01); *C10M 2207/028* (2013.01); *C10M 2207/262* (2013.01); *C10M 2215/28* (2013.01); *C10M 2217/06* (2013.01); *C10M 2219/044* (2013.01); *C10M 2219/046* (2013.01); *C10M 2223/045* (2013.01); *C10N 2220/021* (2013.01); *C10N 2230/04* (2013.01); *C10N 2230/12* (2013.01); *C10N 2230/36* (2013.01); *C10N 2230/45* (2013.01); *C10N 2230/52* (2013.01); *C10N 2240/10* (2013.01); *C10N 2240/101* (2013.01); *C10N 2240/102* (2013.01); *C10N 2240/104* (2013.01)

(58) Field of Classification Search

CPC ..... C10M 2215/28; C10M 2217/022; C10M 2217/044; C10M 2219/046

USPC ..... 508/293–295, 391, 460

See application file for complete search history.

(56) References Cited

U.S. PATENT DOCUMENTS

| | | | | |
|---|---|---|---|---|
| 4,863,623 | A | 9/1989 | Nalesnik | |
| 6,444,624 | B1 | 9/2002 | Walker et al. | |
| 7,361,629 | B2 * | 4/2008 | Loper | C10L 1/221 508/232 |
| 7,407,919 | B2 * | 8/2008 | Wilk | C10M 163/00 508/399 |
| 7,749,948 | B2 * | 7/2010 | Bardasz | C10M 133/56 44/330 |
| 7,863,228 | B2 * | 1/2011 | Loper | C10L 1/221 508/232 |
| 8,071,518 | B2 * | 12/2011 | Yagishita | C10M 169/04 508/287 |
| 8,557,753 | B2 | 10/2013 | Gieselman et al. | |
| 8,569,217 | B2 | 10/2013 | Gieselman et al. | |
| 8,969,266 | B2 * | 3/2015 | Crawley | C10M 159/16 508/306 |
| 9,399,747 | B2 * | 7/2016 | Gieselman | C10M 163/00 |
| 2013/0310287 | A1 * | 11/2013 | Gieselman | C10M 133/12 508/261 |

FOREIGN PATENT DOCUMENTS

| | | |
|---|---|---|
| EP | 1574559 | 9/2005 |
| WO | 2007/117776 | 10/2007 |
| WO | 2008/016967 | 2/2008 |

OTHER PUBLICATIONS

Van Dam, W., et al., "The Impact of Detergent Chemistry on TBN Retention", Tribotest Journal 6-3, 227-240, Mar. 2000.

Corresponding International Publication No. WO 2011/146456 A1 Search Report Issued Aug. 4, 2011.

Written Opinion from corresponding International Application No. PCT/US2011/036776 dated Aug. 4, 2011.

* cited by examiner

*Primary Examiner* — Ellen McAvoy

(74) *Attorney, Agent, or Firm* — Christopher D. Hilker; David M. Shold

(57) ABSTRACT

A lubricant composition of (a) an oil of lubricating viscosity; (b) a dispersant comprising the condensation product of a carboxylic functionalized polymer with an aromatic amine having at least 3 aromatic rings and at least one primary or secondary amino group; and (c) an overbased metal detergent comprising an oil-soluble neutral metal salt component and a metal carbonate component, provides good seal and corrosion performance. Desirably, the total amount of neutral metal salt component in the lubricant composition is at least about 0.75 percent by weight and the sulfated ash level of the lubricant composition is less than about 1.1 percent.

16 Claims, No Drawings

LOW ASH LUBRICANTS WITH IMPROVED SEAL AND CORROSION PERFORMANCE

BACKGROUND OF THE INVENTION

The disclosed technology relates to lubricants, particularly for internal combustion engines including diesel engines, exhibiting good seal performance and corrosion performance in a low ash formulation.

Lubricants for internal combustion engines are well known. For example, U.S. Pat. No. 6,444,624, Walker et al., Sep. 3, 2002, discloses a lubricating oil composition containing 0 to less than 10% Group I and/or Group II basestocks, a molybdenum additive providing not greater than 1000 ppm of molybdenum to the lubricant, a calcium detergent providing 10 or greater mmoles of surfactant per kilogram of lubricant, one or more other lubricant additives selected from, among others, ashless dispersants, and a viscosity modifier.

U.S. Pat. No. 7,361,629, Loper et al., Apr. 22, 2008, discloses an amination product of a hydrocarbyl-substituted succinic acylating agent and a mixture containing an aliphatic polyamine and an aromatic polyamine. Among the aromatic polyamines disclosed is N-phenyl-1,4-phenylenediamine.

U.S. Pat. No. 4,863,623, Nalesnik, Sep. 5, 1989, discloses an additive composition comprising a graft and amine-derivatized copolymer. It discloses an amino-aromatic polyamine compound from the group consisting of, among others, an N-arylphenylenediamine. A lubricating oil composition containing the same is also provided.

The disclosed technology solves the problems of corrosion and seal degradation in low ash engine lubricants by employing a combination of additives as described herein.

SUMMARY OF THE INVENTION

The disclosed technology provides a lubricant composition comprising: (a) an oil of lubricating viscosity; (b) a dispersant comprising the condensation product of a carboxylic functionalized polymer with an aromatic amine having at least 3 aromatic rings and at least one primary or secondary amino group; and (c) an overbased metal detergent comprising an oil-soluble neutral metal salt component and a metal carbonate component; wherein the total amount of neutral metal salt component (from the overbased detergent) in the lubricant composition is at least 0.75 percent by weight (of the composition) and wherein the sulfated ash level of the lubricant composition is less than 1.1 percent.

The disclosed technology further provides a method for lubricating an internal combustion engine, comprising supplying thereto the above lubricant.

DETAILED DESCRIPTION OF THE INVENTION

Various preferred features and embodiments will be described below by way of non-limiting illustration.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is found in paragraphs [0118] to [0119] of International Publication WO2008147704.

One component of the disclosed technology is an oil of lubricating viscosity. The base oil used in the inventive lubricating oil composition may be selected from any of the base oils in Groups I-V as specified in the American Petroleum Institute (API) Base Oil Interchangeability Guidelines. The five base oil groups are as follows:

| Base Oil Category | Sulfur (%) | | Saturates (%) | Visc. Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | >120 |
| Group IV | All polyalphaolefins (PAOs) | | | |
| Group V | All others not included in Groups I, II, III or IV | | | |

Groups I, II and III are mineral oil base stocks. The oil of lubricating viscosity, then, can include natural or synthetic lubricating oils and mixtures thereof. Mixture of mineral oil and synthetic oils, particularly polyalphaolefin oils and polyester oils, are often used.

Natural oils include animal oils and vegetable oils (e.g. castor oil, lard oil and other vegetable acid esters) as well as mineral lubricating oils such as liquid petroleum oils and solvent-treated or acid treated mineral lubricating oils of the paraffinic, naphthenic or mixed paraffinic-naphthenic types. Hydrotreated or hydrocracked oils are included within the scope of useful oils of lubricating viscosity.

Oils of lubricating viscosity derived from coal or shale are also useful. Synthetic lubricating oils include hydrocarbon oils and halosubstituted hydrocarbon oils such as polymerized and interpolymerized olefins and mixtures thereof, alkylbenzenes, polyphenyl, (e.g., biphenyls, terphenyls, and alkylated polyphenyls), alkylated diphenyl ethers and alkylated diphenyl sulfides and their derivatives, analogs and homologues thereof. Alkylene oxide polymers and interpolymers and derivatives thereof, and those where terminal hydroxyl groups have been modified by, for example, esterification or etherification, constitute other classes of known synthetic lubricating oils that can be used. Another suitable class of synthetic lubricating oils that can be used comprises the esters of dicarboxylic acids and those made from C5 to C12 monocarboxylic acids and polyols or polyol ethers.

Other synthetic lubricating oils include liquid esters of phosphorus-containing acids, polymeric tetrahydrofurans, silicon-based oils such as the polyalkyl-, polyaryl-, polyalkoxy-, or polyaryloxy-siloxane oils, and silicate oils.

Hydrotreated naphthenic oils are also known and can be used. Synthetic oils may be used, such as those produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

Unrefined, refined and rerefined oils, either natural or synthetic (as well as mixtures of two or more of any of these)

of the type disclosed hereinabove can used in the compositions of the present invention. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products.

The amount of oil in a fully formulated lubricant will typically be the amount remaining to equal 100 percent after the remaining additives are accounted for. Typically this may be 60 to 99 percent by weight, or 70 to 97 percent, or 80 to 95 percent, or 85 to 93 percent. The disclosed technology may also be delivered as a concentrate, in which case the amount of oil is typically reduced and the concentrations of the other components are correspondingly increased. In such cases the amount of oil may be 30 to 70 percent by weight or 40 to 60 percent.

Polymeric Dispersant

The lubricating composition of the invention contains a polymeric dispersant which comprises a polymer functionalized with a certain type of amine. The amine used for the polymeric dispersant is typically an amine having at least 3 or at least 4 aromatic groups, for instance, 4 to 10 or 4 to 8 or 4 to 6 aromatic groups, and at least one primary or secondary amino group. In some embodiments the amine comprises both a primary and at least one secondary amino group. In certain embodiments, the amine comprises at least 4 aromatic groups and at least 2 secondary or tertiary amino groups. It is generally understood that condensation reactions occur most readily with primary amino groups, so in one embodiment the amine comprises at least one primary amino group and least two secondary or tertiary amino groups—that is to say, at least two other amino groups that are non-primary, i.e., any combination of secondary or tertiary amino groups.

As used herein the term "aromatic group" is used in the ordinary sense of the term and is known to be defined by Hückel theory of 4n+2π electrons per ring system. Accordingly, one aromatic group of the invention may have 6, or 10, or 14π electrons. A benzene ring has 6π electrons, a naphthalene ring has 10π electrons, and an acridine group has 14π electrons.

An example of the amine having at least 3 or 4 aromatic groups may be represented by Formula (1):

Formula 1

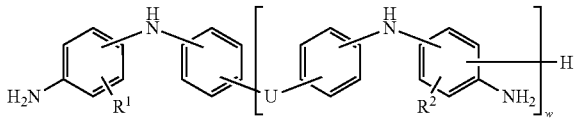

wherein, independently, each variable is as follows: $R^1$ may be hydrogen or a $C_{1-5}$ alkyl group (typically hydrogen); $R^2$ may be hydrogen or a $C_{1-5}$ alkyl group (typically hydrogen); U may be an aliphatic, alicyclic or aromatic group, with the proviso that when U is aliphatic, the aliphatic group may be linear or branched alkylene group containing 1 to 5, or 1 to 2 carbon atoms; and w may be 1 to 10, or 1 to 4, or 1 to 2 (typically 1). In one embodiment, when U is an aliphatic group, U is in particular an alkylene groups containing 1 to 5 carbon atoms.

An example of the amine having at least 3 or 4 aromatic groups may be represented alternatively by Formula (1a):

Formula 1a

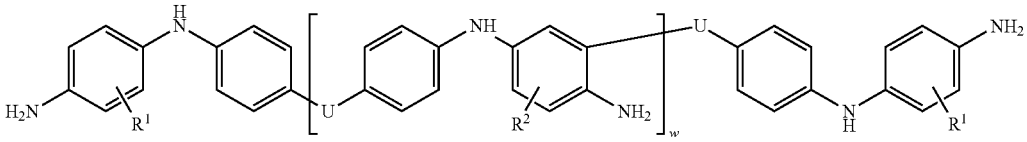

wherein each variable U, $R^1$, and $R^2$ are the same as described above and w is, in this representation, 0 to 9 or 0 to 3 or 0 to 1 (typically 0).

Further examples of an amine having at least 3 or 4 aromatic groups may be represented by any of the following Formulas (2) and/or (3):

Formula (2)

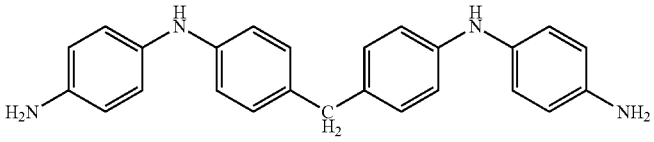

Formula (3)

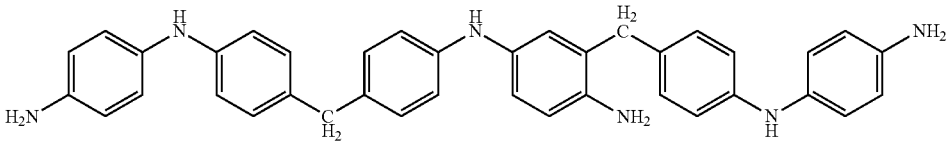

Isomers with various placements of amino groups relative to alkylene bridges are also possible, including, as only one example, that of Formula (2x):

Formula (2x)

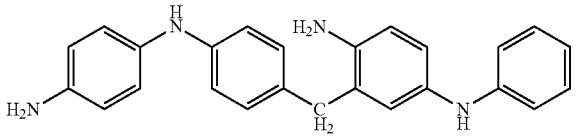

In one embodiment the amine having at least 3 or 4 aromatic groups may include mixtures of compounds represented by the formulas disclosed above. A person skilled in the art will appreciate that compounds of Formulas (2) and (3) may also react with the aldehyde described below to form acridine derivatives, including those represented by Formula (2a) or (3a) to (3c) below. In addition to the compounds represented these formulas, other acridine structures may be possible where the aldehyde reacts with other with benzyl groups bridged with the >NH group.

Formula (2a)

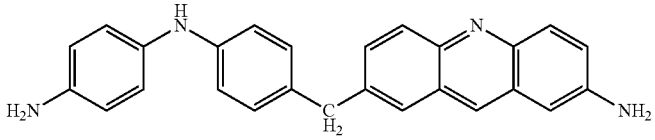

Formula (3a)

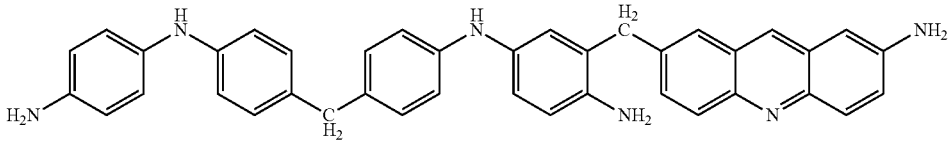

Any or all of the N-bridged aromatic rings are capable of such further condensation and perhaps aromatization. One other of many possible structures is shown in Formula (3b).

Formula (3b)

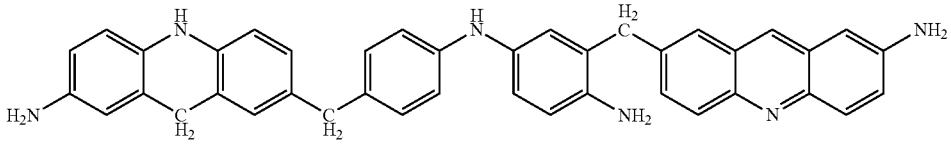

Formula (3c)

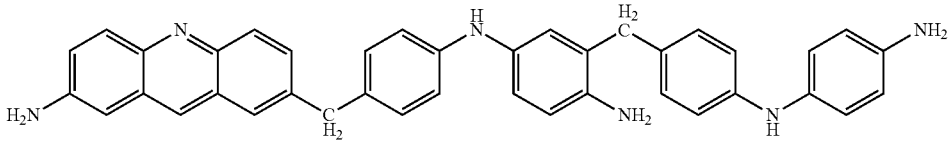

Any of the formulas (2), (2a) (3), or (3a) to (3c) could also have further condensation reactions occurring resulting in one or more acridine moieties forming per molecule.

Examples of the amine having at least 3 or 4 aromatic groups include bis[p-(p-aminoanilino)phenyl]-methane, 2-(7-amino-acridin-2-ylmethyl)-N-4-{4-[4-(4-amino-phenylamino)-benzyl]-phenyl}-benzene-1,4-diamine, N-4-{4-[4-(4-amino-phenylamino)-benzyl]-phenyl}-2-[4-(4-amino-phenylamino)-cyclohexa-1,5-dienylmethyl]-benzene-1,4-diamine, N-[4-(7-amino-acridin-2-ylmethyl)-phenyl]-benzene-1,4-diamine, and mixtures thereof. In one embodiment the amine having at least 3 or 4 aromatic groups may be bis[p-(p-aminoanilino)phenyl]-methane, 2-(7-amino-acridin-2-ylmethyl)-N-4-{4-[4-(4-amino-phenylamino)-benzyl]-phenyl}-benzene-1,4-diamine or mixtures thereof.

The amine having at least 3 or 4 aromatic groups may be prepared by a process comprising reacting an aldehyde with an amine (typically 4-aminodiphenylamine). The resultant amine may be described as an alkylene coupled amine having at least 3 or 4 aromatic groups, at least one —$NH_2$ functional group, and at least 2 secondary or tertiary amino groups. The aldehyde used for the coupling may be aliphatic, alicyclic or aromatic. The aliphatic aldehyde may be linear or branched. Examples of suitable aromatic aldehydes include benzaldehyde and ovanillin. Examples of aliphatic aldehydes include formaldehyde (or a reactive equivalent thereof such as formalin or paraformaldehyde), ethanal, and propanal. Typically the aldehyde may be formaldehyde or benzaldehyde.

Alternatively, the amine having at least 3 or 4 aromatic groups may also be prepared by the methodology described in *Berichte der Deutschen Chemischen Gesellschaft* (1910), 43, 728-39.

In one embodiment the amine having at least 3 or 4 aromatic groups may be obtained or obtainable by a process comprising reacting isatoic anhydride or alkyl substituted isatoic anhydride, with an aromatic amine with at least two aromatic groups and a reactive primary or secondary amino group. The resultant material may be described as an anthranilic derivative.

In one embodiment the anthranilic derivative may be prepared by reacting isatoic anhydride or alkyl substituted isatoic anhydride and an aromatic amine selected from the group consisting of xylylenediamine, 4-aminodiphenylamine, 1,4-dimethylphenylenediamine, and mixtures thereof. In one embodiment the aromatic amine may be 4-aminodiphenylamine.

The process described above to prepare the anthranilic derivative may be carried out at a reaction temperature in the range of 20° C. to 180° C., or 40° C. to 110° C. The process may (or may not) be carried out in the presence of a solvent. Examples of suitable solvents include water, diluent oil, benzene, t-butyl benzene, toluene, xylene, chlorobenzene, hexane, tetrahydrofuran, or mixtures thereof. The reactions may be performed in either air or an inert atmosphere such as nitrogen or argon, typically nitrogen.

Carboxylic Functionalized Polymer

The amine-functionalized polymeric dispersant may be the reaction product of the amine having at least 3 or 4 aromatic groups, described above, with a carboxylic functionalized polymer. The resultant product may be described as being an amine-functionalized carboxylic functionalized polymer.

The carboxylic functionalized polymer backbone may be a homopolymer or a copolymer, provided that it contains at least one carboxylic acid functionality or a reactive equivalent of carboxylic acid functionality (e.g., anhydride or ester). The carboxylic functionalized polymer may have a carboxylic acid functionality (or a reactive equivalent of carboxylic acid functionality) grafted onto the backbone, within the polymer backbone or as a terminal group on the polymer backbone. All of these are intended to be encompassed by the term "carboxylic functionalized."

The carboxylic functionalized polymer may be a polyisobutylene-substituted succinic anhydride, a maleic anhydride-styrene copolymer, an ester of a maleic anhydride-styrene copolymer, an alpha olefin-maleic anhydride copolymer, or a maleic anhydride graft copolymer of (i) a styrene-ethylene-alpha olefin polymer, (ii) a hydrogenated alkenyl aryl conjugated diene copolymer (that is, a hydrogenated alkenyl arene conjugated diene copolymer, in particular a hydrogenated copolymer of styrene-butadiene), (iii) a polyolefin grafted with maleic anhydride (in particular ethylene-propylene copolymer), or (iv) a isoprene polymer (in particular non-hydrogenated isobutylene-isoprene copolymer or a hydrogenated styrene-isoprene polymer), or mixtures thereof.

The carboxylic functionalized polymer described herein is known in lubricant technology. For example esters of maleic anhydride and styrene-containing polymers are known from U.S. Pat. No. 6,544,935. Grafted styrene-ethylene-alpha olefin polymers are taught in International publication WO 01/30947. Copolymers derived from isobutylene and isoprene have been used in preparing dispersants and are reported in International publication WO 01/98387. Grafted styrene-butadiene and styrene-isoprene copolymers are described in a number of references including DE 3,106,959; and U.S. Pat. Nos. 5,512,192, and 5,429,758. Polyisobutylene succinic anhydrides have been described in numerous publications including U.S. Pat. Nos. 4,234,435; 3,172,892; 3,215,707; 3,361,673; and 3,401,118. Grafted ethylene-propylene copolymers have been described in U.S. Pat. Nos. 4,632,769; 4,517,104; and 4,780,228. Esters of (alpha-olefin maleic anhydride) copolymers have been described in U.S. Pat. No. 5,670,462. Copolymers of isobutylene and conjugated dienes (such as isobutylene-isoprene copolymer) have been described in U.S. Pat. Nos. 7,067,594 and 7,067,594 and US Patent Application US 2007/0293409. And terpolymers of ethylene, propylene and non-conjugated diene (such as dicyclopentadiene or butadiene) are described in U.S. Pat. Nos. 5,798,420 and 5,538,651. Typically the polymers mentioned in this paragraph that contain diene monomers (e.g., butadiene or isoprene) are partially or wholly hydrogenated. Many of the polymer backbones are also described in "Chemistry and Technology of Lubricants, Second Edition, edited by R. M. Mortier and S. T. Orszulik, published by Blackie Academic & Professional. In particular pages 144-180 discuss many of the polymer backbones (i)-(iv) and (vi)-(viii).

The polymer backbone (other than a polyisobutylene) of the present invention may have a number average molecular weight (by gel permeation chromatography, polystyrene standard), which may be up to 150,000 or higher, e.g., 1,000 or 5,000 to 150,000 or to 120,000 or to 100,000. An example of a suitable number average molecular weight range includes 10,000 to 50,000, or 6,000 to 15,000, or 30,000 to 50,000. In one embodiment, the polymer backbone has a number average molecular weight of greater than 5,000, for instance, greater than 5000 to 150,000. Other combinations of the above-identified molecular weight limitations are also contemplated. When the polymer backbone of the invention is a polyisobutylene, its number average molecular weight (by gel permeation chromatography, polystyrene standard), may be 350 to 15,000, or 550 to 10,000, or 500 to 10,000, or 750 to 5000 or 750 to 2500. (Thus, a polyisobutylene succinic anhydride may be derived from a polyisobutylene with any of the foregoing molecular weights.) Certain commercially available polyisobutylene polymers have a number average molecular weight of 550, 750, 950-1000, 1550, 2000, or 2250. Some of the commercially available polyisobutylene polymers may obtain the number average molecular weights shown above by blending one or more polyisobutylene polymers of different weights. In one embodiment, the carboxylic functionalized polymer comprises a polyisobutylene of number average molecular weight of about 500 to about 10,000 bearing at least one succinic group (typically from a reaction of the polyisobutylene with maleic anhydride).

In one embodiment the product may be obtained or obtainable by reacting a carboxylic functionalised polymer with an amine or an amine-functionalised additive having at least 3 or 4 aromatic groups, at least one —$NH_2$ functional group, and at least 2 secondary or tertiary amino groups. The amine or amine-functionalized additive having at least 3 or 4 aromatic groups may be reacted with the carboxylic functionalized polymer under reaction conditions that will be well known to a person skilled in the art for forming imides and/or amides of carboxylic functionalized polymers.

The amine-functionalized carboxylic functionalized polymer obtained or obtainable by reacting a carboxylic functionalised polymer with an amine having at least 3 or 4 aromatic groups, at least one —$NH_2$ functional group, and at least 2 secondary or tertiary amino groups may in certain embodiment be represented by the Formulae (4) and/or (5):

Formula (4)

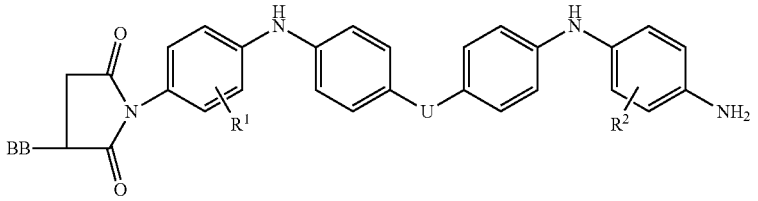

or

Formula (5)

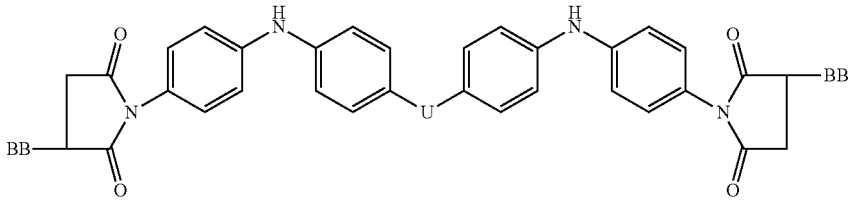

wherein, independently, each variable $R^1$, $R^2$ and U are as described previously. BB represents a polymer backbone and may be polyisobutylene, or alternatively copolymers of (i) hydrogenated alkenyl aryl conjugated diene copolymers (in particular hydrogenated copolymers of styrene-butadiene), (ii) polyolefins (in particular ethylene-α olefins such as ethylene-propylene copolymers), (iii) hydrogenated isoprene polymers (in particular hydrogenated styrene-isoprene polymers), or (iv) a copolymer of isoprene and isobutylene. BB may be substituted with one succinimide group as shown in formulas (4) and (5), or it may be substituted by multiple succinimide groups. In one embodiment BB may be a copolymer of isoprene and isobutylene. The amine moieties shown in formulas (4) and (5) may also be replaced, in whole, or in part, by corresponding amine moieties of formulas (2a), (3), (3a), (3b), (3c), or mixtures thereof.

When the polymer backbone BB is polyisobutylene, the resultant carboxylic functionalized polymer may typically be polyisobutylene succinic anhydride. Typically w, as defined in Formula (1), may be 1 to 5, or 1 to 3 (or as defined in Formula (1a), w may be 0 to 4 or 0 to 2). When BB is other than polyisobutylene and has maleic anhydride (or other carboxylic acid functionality) grafted thereon, one or more of the grafted maleic anhydride groups may be a succinimide formed by reaction with one or more of the aforementioned amines. The number of succinimide groups may be 1 to 40, or 2 to 40, or 3 to 20.

The amine-functionalized carboxylic functionalized polymer may be obtained or obtainable by reacting a carboxylic functionalized polymer derived from maleic anhydride-styrene copolymers, esters of maleic anhydride-styrene copolymers, alpha-olefin maleic anhydride copolymers; or mixtures thereof with an amine having at least 3 or 4 aromatic groups, at least one —$NH_2$ functional group, and at least 2 secondary or tertiary amino groups. Typically the product of this type may be described as an alternating copolymer. Within the alternating copolymer one or more of the maleic anhydride derived groups may have a group represented by Formula (6):

Formula (6)

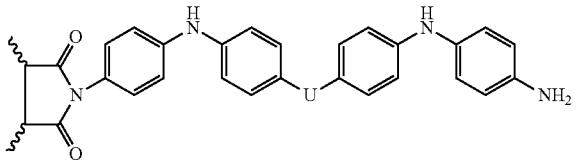

wherein $R^1$, $R^2$ and U are described previously, and the group of Formula (6) may be bonded to further components of the polymer backbone through one or both wavy bonds shown on the maleic or succinic ring structure above. Alternatively, only one wavy bond may attach to the polymer and the second wavy bond may be to a hydrogen atom or other non-polymeric group. The amine-derived group in formula (6) may also be replaced by the any of the above-described amines such as the amine in formula (3), or mixtures thereof.

Certain aromatic amines may also be described as anthranilic derivatives derived from, e.g., an isatoic anhydride. As an example of suitable structures of the anthranilic derivative derived from polyisobutylene (denoted as "PIB" in Formula (7)), the anthranilic derivative and 4-aminodiphenylamine may be represented by Formula (7):

Formula (7)

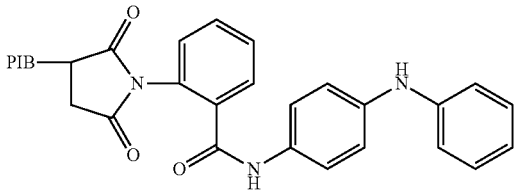

It should be noted that here, as in other dispersants, there are a variety of types of attachments of the succinimide moiety to the polyisobutylene besides a simple single bond, including various cyclic attachment structures, and the structure illustrated is not intended to be limiting.

In one embodiment the amine-functionalized carboxylic functionalized polymer may be derived from one of the aromatic amines and from a non-polyisobutylene polymer backbone. Examples of suitable structures of the anthranilic derivative derived from 4-aminodiphenylamine may be represented by Formula (8):

Formula (8)

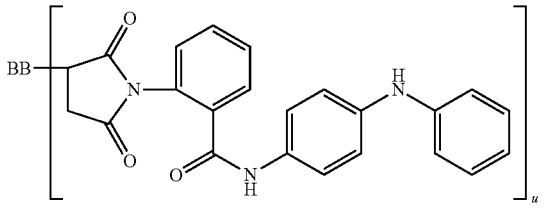

wherein BB, as above, represents a polymer backbone. Typically BB may be an ethylene-propylene copolymer derived from ethylene-propylene copolymers. As shown, BB is grafted with maleic anhydride and functionalized to form the imide group, and u is the number of grafted units shown within the brackets, grafted at various locations on the backbone. Typically u may be 1 to 2000, or 1 to 500, or 1 to 250, or 1 to 50, 1 to 20, 1 to 10, or 1 to 4.

A more detailed description of the amine-functionalized carboxylic functionalized polymer is found in International Application PCT/US2008/082944. In particular see paragraphs [0013] to [0021], [0027] to [0091] and the preparative examples 1 to 25 disclosed in paragraphs [0111] to [0135].

The amount of the polymeric dispersant in a fully formulated lubricant may be at least 0.6 percent by weight, such as 0.6 or 0.75 or 1.0 to 10 percent, or 1.5 to 8 percent, or 2 to 6 percent by weight. Alternatively, if the polymeric dispersant is supplied as a concentrate, the amount of dispersant present in the concentrate will be correspondingly higher, such as 2 to 30 percent or 5 to 20 percent.

Another component of the disclosed technology is an overbased metal detergent. Overbased metal detergents may be viewed as comprising an oil-soluble neutral metal salt component and a metal carbonate component. Metal-containing detergents are typically overbased materials, or overbased detergents. Overbased materials, otherwise referred to as overbased or superbased salts, are generally homogeneous Newtonian systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, in one embodiment carbon dioxide) with a mixture comprising an acidic organic compound, a reaction medium comprising at least one inert, organic solvent (e.g., mineral oil, naphtha, toluene, xylene) for the acidic organic material, a stoichiometric excess of a metal base, and a promoter such as a phenol or alcohol and optionally ammonia. The acidic organic material will normally have a sufficient number of carbon atoms, for instance, as a hydrocarbyl substituent, to provide a reasonable degree of solubility in oil. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5.

Overbased detergents are often characterized by Total Base Number (TBN, ASTM D 4739 or D 974). TBN is the amount of strong acid needed to neutralize all of the overbased material's basicity, expressed as potassium hydroxide equivalents (mg KOH per gram of sample). Since overbased detergents are commonly provided in a form which contains a certain amount of diluent oil, for example, 40-50% oil, the actual TBN value for such a detergent will depend on the amount of such diluent oil present, irrespective of the "inherent" basicity of the overbased material. For the purposes of the present invention, the TBN of an overbased detergent is to be recalculated to an oil-free basis. Detergents which are useful in the present invention may have a TBN (oil-free basis) of 100 to 800, and in one embodiment 150 to 750, and in another, 400 to 700. If multiple detergents are employed, the overall TBN of the detergent component (that is, an average of all the specific detergents together) will typically be in the above ranges.

The metal compounds useful in making the basic metal salts are generally any Group 1 or Group 2 metal compounds (CAS version of the Periodic Table of the Elements). The Group 1 metals of the metal compound include Group 1a alkali metals such as sodium, potassium, and lithium, as well as Group 1b metals such as copper. The Group 1 metals can be sodium, potassium, lithium and copper, and in one embodiment sodium or potassium, and in another embodiment, sodium. The Group 2 metals of the metal base include the Group 2a alkaline earth metals such as magnesium, calcium, and barium, as well as the Group 2b metals such as zinc or cadmium. In one embodiment the Group 2 metals are magnesium, calcium, barium, or zinc, and in another embodiments magnesium or calcium. In certain embodiments the metal is calcium or sodium or a mixture of calcium and sodium. Generally the metal compounds are delivered as metal salts. The anionic portion of the salt can be hydroxide, oxide, carbonate, borate, or nitrate.

In one embodiment the lubricants of the present invention can contain an overbased sulfonate detergent. Suitable sulfonic acids include sulfonic and thiosulfonic acids. Sulfonic acids include the mono- or polynuclear aromatic or cycloaliphatic compounds. Oil-soluble sulfonates can be represented for the most part by one of the following formulas: $R^2$-T-$(SO_3—)_a$ and $R^3$—$(SO_3—)_b$, where T is a cyclic nucleus such as typically benzene; $R^2$ is an aliphatic group such as alkyl, alkenyl, alkoxy, or alkoxyalkyl; $(R^2)$-T typically contains a total of at least 15 carbon atoms; and $R^3$ is an aliphatic hydrocarbyl group typically containing at least 15 carbon atoms. Examples of $R^3$ are alkyl, alkenyl, alkoxyalkyl, and carboalkoxyalkyl groups. The groups T, $R^2$, and $R^3$ can also contain other inorganic or organic substituents. In the above formulas, a and b are at least 1. In one embodiment the sulfonate detergent may be a predominantly linear alkylbenzenesulfonate detergent having a metal ratio of at least 8 as described in paragraphs [0026] to [0037] of US Patent Application 2005065045. In some embodiments the linear alkyl group may be attached to the benzene ring anywhere along the linear chain of the alkyl group, but often in the 2, 3 or 4 position of the linear chain, and in some instances predominantly in the 2 position.

Another overbased material which can be present is an overbased phenate detergent. The phenols useful in making phenate detergents can be represented by the formula $(R^1)_a$—Ar—$(OH)_b$, wherein R' is an aliphatic hydrocarbyl group of 4 to 400 carbon atoms, or 6 to 80 or 6 to 30 or 8 to 25 or 8 to 15 carbon atoms; Ar is an aromatic group (which can be a benzene group or another aromatic group such as naphthalene); a and b are independently numbers of at least one, the sum of a and b being in the range of two up to the number of displaceable hydrogens on the aromatic nucleus or nuclei of Ar. In one embodiment, a and b are independently numbers in the range of 1 to 4, or 1 to 2. R' and a are typically such that there are an average of at least 8 aliphatic carbon atoms provided by the R' groups for each phenol compound. Phenate detergents are also sometimes provided as sulfur-bridged species.

In one embodiment, the overbased material is an overbased saligenin detergent. Overbased saligenin detergents are commonly overbased magnesium salts which are based on saligenin derivatives. A general example of such a saligenin derivative can be represented by the formula

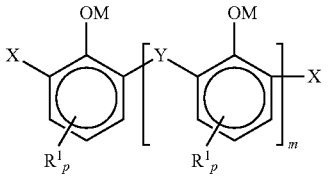

wherein X comprises —CHO or —$CH_2OH$, Y comprises —$CH_2$— or —$CH_2OCH_2$—, and wherein such —CHO groups typically comprise at least 10 mole percent of the X and Y groups; M is hydrogen, ammonium, or a valence of a metal ion (that is to say, in the case of a multivalent metal ion, one of the valences is satisfied by the illustrated structure and other valences are satisfied by other species such as anions, or by another instance of the same structure), $R^1$ is a hydrocarbyl group containing 1 to 60 carbon atoms, m is 0 to typically 10, and each p is independently 0, 1, 2, or 3, provided that at least one aromatic ring contains an R' substituent and that the total number of carbon atoms in all R' groups is at least 7. When m is 1 or greater, one of the X groups can be hydrogen. In one embodiment, M is a valence of a Mg ion or a mixture of Mg and hydrogen. Saligenin detergents are disclosed in greater detail in U.S. Pat. No. 6,310,009, with special reference to their methods of synthesis (Column 8 and Example 1) and preferred amounts of the various species of X and Y (Column 6).

Salixarate detergents are overbased materials that can be represented by a substantially linear compound comprising at least one unit of formula (I) or formula (II):

(I)

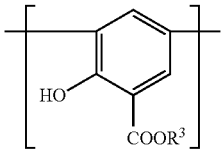

(II)

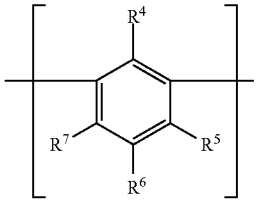

each end of the compound having a terminal group of formula (III) or (IV):

(III)

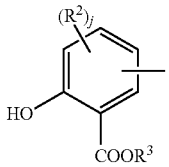

(IV)

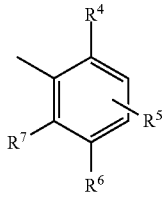

such groups being linked by divalent bridging groups A, which may be the same or different for each linkage; wherein in formulas (I)-(IV) $R^3$ is hydrogen or a hydrocarbyl group or a valence of a metal ion; $R^2$ is hydroxyl or a hydrocarbyl group and j is 0, 1, or 2; $R^6$ is hydrogen, a hydrocarbyl group, or a hetero-substituted hydrocarbyl group; either $R^4$ is hydroxyl and $R^5$ and $R^7$ are independently either hydrogen, a hydrocarbyl group, or hetero-substituted hydrocarbyl group, or else $R^5$ and $R^7$ are both hydroxyl and $R^4$ is hydrogen, a hydrocarbyl group, or a hetero-substituted hydrocarbyl group; provided that at least one of $R^4$, $R^5$, $R^6$ and $R^7$ is hydrocarbyl containing at least 8 carbon atoms; and wherein the molecules on average contain at least one of unit (I) or (III) and at least one of unit (II) or (IV) and the ratio of the total number of units (I) and (III) to the total number of units of (II) and (IV) in the composition is about 0.1:1 to about 2:1. The divalent bridging group "A," which may be the same or different in each occurrence, includes —$CH_2$— (methylene bridge) and —$CH_2OCH_2$— (ether bridge), either of which may be derived from formaldehyde or a formaldehyde equivalent (e.g., paraform, formalin).

Salixarate derivatives and methods of their preparation are described in greater detail in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate."

The overbased detergent can also be an overbased salicylate which may be an alkali metal salt or an alkaline earth metal salt of a substituted salicylic acid. The salicylic acids may be hydrocarbyl-substituted salicylic acids wherein each substituent contains an average of at least 8 carbon atoms per substituent and 1 to 3 substituents per molecule. The substituents can be polyalkene substituents, where polyalkenes include homopolymers and interpolymers of polymerizable olefin monomers of 2 to 16, or 2 to 6, or 2 to 4 carbon atoms. The olefins may be monoolefins such as ethylene, propylene, 1-butene, isobutene, and 1-octene; or a polyolefinic monomer, such as diolefinic monomer, such 1,3-butadiene and isoprene. In one embodiment, the hydrocarbyl substituent group or groups on the salicylic acid contains 7 to 300 carbon atoms and can be an alkyl group having a molecular weight of 150 to 2000. The polyalkenes and polyalkyl groups are prepared by conventional procedures, and substitution of such groups onto salicylic acid can be effected by known methods. Alkyl salicylates may be prepared from an alkylphenol by Kolbe-Schmitt reaction; alternatively, calcium salicylate can be produced by direct neutralization of alkylphenol and subsequent carbonation. Overbased salicylate detergents and their methods of preparation are disclosed in U.S. Pat. Nos. 4,719,023 and 3,372,116.

Other overbased detergents can include overbased detergents having a Mannich base structure, as disclosed in U.S. Pat. No. 6,569,818.

Overbased materials are well known to those skilled in the art. Patents describing techniques for making basic salts of sulfonic acids, carboxylic acids, (hydrocarbyl-substituted) phenols, phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

In the disclosed technology, the overbased metal detergent comprises an oil-soluble neutral metal salt component and a metal carbonate component. By "neutral metal salt" is meant the salt represented by a stoichiometric neutralization of the oil-soluble acidic material and having a metal ratio of 1, regardless of whether such a salt would be strictly neutral or might measure as somewhat acidic or basic by any given test or titration. The "amount of neutral salt" is intended as a measure tied to the amount of acidic substrate that has been overbased, which will differ from the amount of neutral salt by the mass of the neutralizing metal in a manner that may be readily calculated. The amount of the neutral metal salt component may be readily determined by the person skilled in the art from a knowledge of the total amount of the detergent present and the extent of overbasing or metal ratio or TBN of the detergent. In one embodiment, the TBN measurement is used to calculate or define the amount of neutral metal salt. For example, 1 g (oil free) of an overbased calcium sulfonate detergent having a TBN (oil free) of 517 will contain about 0.46 g $CaCO_3$ ([517 mg KOH/g]×[1 eq KOH/56,100 mg KOH]×[50 g $CaCO_3$/1 eq KOH]). By subtraction, the amount of neutral soap is about 0.54 g or 54%. (Any inherent residual basicity of the substrate should be discounted from the measured TBN before calculating the amount of neutral soap, as will be apparent to the person skilled in the art.)

For the present technology, the amount of the detergents in a lubricant should be such that the amount of the neutral metal salt component or components is at least 0.75 percent by weight or alternatively at least 1.0 percent, and up to 3 or 2 or 1.8 or 1.5 percent by weight. The corresponding amount of the overbased detergents as a whole in a lubricant, that is, including the metal carbonate component but excluding any diluent oils, may be 1 to 8 percent, or 1.3 to 5 percent, or 1.5 to 2.5 percent by weight. In a concentrate, the amounts will be correspondingly higher.

The lubricants of the present technology will be formulated to have a sulfated ash content (ASTM D 874) of less than 1.1 percent, alternatively less than 1.0 or 0.95 or 0.9 or 0.85 weight percent.

Lubricants incorporating the disclosed technology may also contain one or more of the various additives that are known for use in lubricants. One common additive is a dispersant, that is, a supplemental dispersant other than those described above containing the aromatic amine having at least 3 aromatic rings and at least one primary or secondary amino group. Dispersants are well known in the field of lubricants and include primarily what is known as ashless dispersants and polymeric dispersants. Ashless dispersants are so-called because, as supplied, they do not contain metal and thus do not normally contribute to sulfated ash when added to a lubricant. However they may, of course, interact with ambient metals once they are added to a lubricant which includes metal-containing species. Ashless dispersants are characterized by a polar group attached to a relatively high molecular weight hydrocarbon chain. Typical ashless dispersants include N-substituted long chain alkenyl succinimides, having a variety of chemical structures including typically

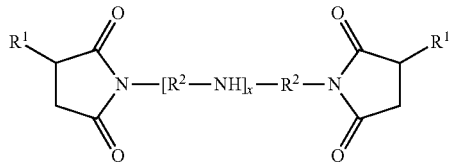

where each $R^1$ is independently an alkyl group, frequently a polyisobutylene group with a molecular weight (Mn) of 500-5000 based on the polyisobutylene precursor, and $R^2$ are alkylene groups, commonly ethylene ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. Also, a variety of modes of linkage of the R' groups onto the imide structure are possible, including various cyclic linkages. The ratio of the carbonyl groups of the acylating agent to the nitrogen atoms of the amine may be 1:0.5 to 1:3, and in other instances 1:1 to 1:2.75 or 1:1.5 to 1:2.5. Succinimide dispersants are more fully described in U.S. Pat. Nos. 4,234,435 and 3,172,892 and in EP 0355895.

Another class of ashless dispersant is high molecular weight esters. These materials are similar to the above-described succinimides except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022. Another class of ashless dispersant is Mannich bases. These are materials which are formed by the condensation of a higher molecular weight, alkyl substituted phenol, an alkylene polyamine, and an aldehyde such as formaldehyde. Such materials are described in more detail in U.S. Pat. No. 3,634,515. Yet other dispersants include polymeric dispersant additives, which are generally hydrocarbon-based polymers which contain polar functionality to impart dispersancy characteristics to the polymer.

Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatment are listed in U.S. Pat. No. 4,654,403.

The lubricant may also contain a metal salt of a phosphorus acid. Metal salts of the formula $[(R^8O)(R^9O)P(=S)—S]_n$-M where $R^8$ and $R^9$ are independently hydrocarbyl groups containing 3 to 30 carbon atoms, are readily obtainable by heating phosphorus pentasulfide ($P_2S_5$) and an alcohol or phenol to form an O,O-dihydrocarbyl phosphorodithioic acid. The alcohol which reacts to provide the $R^8$ and $R^9$ groups may be a mixture of alcohols, for instance, a mixture of isopropanol and 4-methyl-2-pentanol, and in some embodiments a mixture of a secondary alcohol and a primary alcohol, such as isopropanol and 2-ethylhexanol. The resulting acid may be reacted with a basic metal compound to form the salt. The metal M, having a valence n, generally is aluminum, lead, tin, manganese, cobalt, nickel, zinc, or copper, and in many cases, zinc, to form zinc dialkyldithiophosphates. Such materials are well known and readily available to those skilled in the art of lubricant formulation. Suitable variations to provide good phosphorus retention in an engine are disclosed, for instance, in US published application 2008-0015129, see, e.g., claims.

Another component frequently used is a viscosity modifier. Viscosity modifiers (VM) and dispersant viscosity modifiers (DVM) are well known. Examples of VMs and DVMs may include polymethacrylates, polyacrylates, polyolefins, styrene-maleic ester copolymers, and similar polymeric substances including homopolymers, copolymers and graft copolymers. The DVM may comprise a nitrogen-containing methacrylate polymer, for example, a nitrogen-containing methacrylate polymer derived from methyl methacrylate and dimethylaminopropyl amine.

Examples of commercially available VMs, DVMs and their chemical types may include the following: polyisobutylenes (such as Indopol™ from BP Amoco or Parapol™ from ExxonMobil); olefin copolymers (such as Lubrizol™ 7060, 7065, and 7067 from Lubrizol and Lucant™ HC-2000L and HC-600 from Mitsui); hydrogenated styrene-diene copolymers (such as Shellvis™ 40 and 50, from Shell and LZ® 7308, and 7318 from Lubrizol); styrene/maleate copolymers, which are dispersant copolymers (such as LZ® 3702 and 3715 from Lubrizol); polymethacrylates, some of which have dispersant properties (such as those in the Viscoplex™ series from RohMax, the Hitec™ series from Afton, and LZ 7702™, LZ 7727™, LZ 7725™ and LZ 7720C™ from Lubrizol); olefin-graft-polymethacrylate polymers (such as Viscoplex™ 2-500 and 2-600 from RohMax); and hydrogenated polyisoprene star polymers (such as Shellvis™ 200 and 260, from Shell). Viscosity modifiers that may be used are described in U.S. Pat. Nos. 5,157,088, 5,256,752 and 5,395,539. The VMs and/or DVMs may be used in the functional fluid at a concentration of up to 20% by weight. Concentrations of 1 to 12% or 3 to 10% by weight may be used.

Another component is an antioxidant. Antioxidants encompass phenolic antioxidants, which may comprise a butyl substituted phenol containing 2 or 3 t-butyl groups. The para position may also be occupied by a hydrocarbyl group or a group bridging two aromatic rings. The latter antioxidants are described in greater detail in U.S. Pat. No. 6,559,105. Antioxidants also include aromatic amine, such as nonylated diphenylamines. Other antioxidants include sulfurized olefins, titanium compounds, and molybdenum compounds. U.S. Pat. No. 4,285,822, for instance, discloses lubricating oil compositions containing a molybdenum and sulfur containing composition. U.S. Patent Application Publication 2006-0217271 discloses a variety of titanium compounds, including titanium alkoxides and titanated dispersants, which materials may also impart improvements in deposit control and filterability. Typical amounts of antioxidants will, of course, depend on the specific antioxidant and its individual effectiveness, but illustrative total amounts can be 0.01 to 5 percent by weight or 0.15 to 4.5 percent or 0.2 to 4 percent. Additionally, more than one antioxidant may be present, and certain combinations of these can be synergistic in their combined overall effect.

Another additive is an antiwear agent. Examples of antiwear agents include phosphorus-containing antiwear/extreme pressure agents such as metal thiophosphates (such as zinc dialkyldithiophosphates, described above), phosphoric acid esters and salts thereof, phosphorus-containing carboxylic acids, esters, ethers, and amides; and phosphites. In certain embodiments a phosphorus antiwear agent may be present in an amount to deliver 0.01 to 0.2 or 0.015 to 0.15 or 0.02 to 0.1 or 0.025 to 0.08 percent phosphorus. Non-phosphorus-containing anti-wear agents include borate esters (including borated epoxides), dithiocarbamate compounds, molybdenum-containing compounds, and sulfurized olefins. Other types of antiwear agents include tartrate esters, tartramides, and tartrimides, such as oleyl tartrimide, as well as esters, amides, and imides of hydroxy-polycarboxylic acids in general. These materials may also impart additional functionality to a lubricant beyond antiwear performance. These materials are described in greater detail in US Publication 2006-0079413 and U.S. Provisional Application 61/120,932, filed 9 Dec. 2008.

Other additives that may optionally be used in lubricating oils include pour point depressing agents, extreme pressure agents, anti-corrosion agents, color stabilizers, and anti-foam agents.

The present technology may be used for the lubrication of any of a variety of mechanical equipment, including an internal combustion engine, by supplying thereto any of the above-described lubricants. In certain embodiments the engine may be a diesel (compression-ignited) engine such as a heavy duty diesel engine. Other possible engines include gasoline (spark-ignited) engines, and engines consuming alcohols, gasoline-alcohol mixtures, biodiesel fuels, various mixed fuels, synthetic fuels, or gaseous fuels such as natural gas or hydrogen, two-stroke cycle engines, and marine diesel engines.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

Examples

Preparative Example 1

Part (a). 500 mL of 2M hydrochloric acid is added to a one-liter 4-neck flask equipped with an overhead stirrer, thermowell, addition funnel with nitrogen line, and condenser. 184.2 g of 4-aminodiphenylamine is added, and the flask is heated to 75° C. The addition funnel is then charged with 40.5 g of a 37% formaldehyde solution and the solution is added drop-wise to the flask over a period of 30 minutes. The flask is maintained at 100° C. for 4 hours. The flask is then cooled to ambient temperature. 80 g of a 50/50 wt/wt solution of sodium hydroxide in water is added over 30 minutes. At the end of the reaction, a solid product is obtained via filtration.

Part (b) A three-liter, 4-neck flask equipped with an overhead stirrer, thermowell, subsurface inlet with nitrogen line, and Dean-Stark trap with condenser is charged with polyisobutylene succinic anhydride (1270.0 g) (where the polyisobutylene has a number average molecular weight of 2000) and diluent oil (1400.1 g). The flask is heated to 90° C. The solid product of part (a) (442.0 g) is then added slowly. The temperature is then raised to 110° C. and held until water is removed. The temperature is then raised to 160° C. and held for 10 hours. To the flask is added a portion of a diatomaceous earth filter aid, and the flask contents are filtered through a second portion of the diatomaceous earth filter aid. The resultant product is a dark oil with a nitrogen content of 0.65 wt %.

Lubricant formulations are prepared as indicated in the table below. Each formulation is formulated to be a 1.0% Sulfated Ash (ASTM D 874) and to have an overall TBN of 10. The lubricants are tested for fluorocarbon seal performance, in terms of tensile strength change and elongation to break change, in a test that involves immersion of fluorocarbon seal samples in a 350 g sample of lubricant at 150° C. for 168 hours. A lesser percentage reduction in tensile strength and elongation indicates a better result. The lubricants are also evaluated for copper and lead corrosion, per ASTM D 6594.

| Material, %[a] | | Ref. 1 | Ref. 2 | Ex 1 | Ex 2 |
|---|---|---|---|---|---|
| Polyisobutylene ($M_n$ 1600-3000) reacted with maleic anhydride and condensed with the 2:1 reaction product of aminodiphenylamine and formaldehyde | | — | 1.50 | 1.50 | 1.50 |
| Dispersant/viscosity booster based on olefin copolymer and other aromatic amines (amines of 1 and 2 aromatic rings) | | 0.67 | 0.50 | 0.50 | 0.50 |
| Conventional succinimide dispersants based on polyalkylenepolyamine | | 5.67 | 1.43 | 1.43 | 1.43 |
| Total amount of dispersants | | 6.34 | 5.93 | 5.93 | 5.93 |
| Ca sulfonate detergent, 160 TBN | | 0.37 | | 1.03 | 0.78 |
| Ca sulfonate detergent, 517 TBN | | 0.53 | 0.69 | | |
| Ca phenate detergent, 199 TBN | | 0.40 | | | |
| Ca phenate detergent, 418 TBN | | 0.41 | 1.64 | | |
| Mg sulfonate detergent, 588 TBN | | | | 0.71 | 0.71 |
| Mg saligenin detergent, 138 TBN | | | | | 0.50 |
| Total amount of detergents | | 1.71 | 2.33 | 1.74 | 1.99 |
| Total % detergent substrate[c] | | 1.16 | 0.72 | 1.08 | 1.35 |
| Other materials (not corrected for diluent oil, if any): | | | | | |
| Antioxidants | | 1.73[b] | 1.70 | 1.70 | 1.70 |
| Zinc dialkyldithiophosphate | | 1.09 | 1.10 | 1.10 | 1.10 |
| Other | | 0.13 | 0.13 | 0.13 | 0.13 |
| Seal performance, | % Tensile change | −64.7 | −47.7 | −37.1 | −27.0 |
| | % Elongation change | −41.4 | −47.9 | −38.2 | −29.6 |
| Corrosion, | ppm Cu | 12 | 7 | 6 | 7 |
| | ppm Pb | 104 | 21 | 8 | 11 |

[a]All dispersants and detergents are presented on an oil free (active chemical) basis. Reported TBNs are also corrected by factoring out the amount of diluent oil.
[b]Contains a different balance of antioxidants from the other examples.
[c]That is, the oil-soluble neutral metal salt component of the detergent.

The results show that Examples 1 and 2, which contain both the dispersant polymer functionalized with the 2:1 reaction product of aminodiphenylamine and formaldehyde and the higher amount of detergent substrate, exhibit better seal performance and better corrosion performance than do the reference examples.

Each of the documents referred to above is incorporated herein by reference. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A lubricant composition comprising:

(a) an oil of lubricating viscosity;

(b) a dispersant comprising the condensation product of a carboxylic functionalized polymer with an aromatic amine having at least 3 aromatic rings and at least one primary or secondary amino group, said aromatic amine being an anthranilic derivative; and (c) an overbased metal detergent comprising an oil-soluble neutral metal salt component and a metal carbonate component;

wherein the total amount of neutral metal salt component in the lubricant composition is at least about 0.75 percent by weight and wherein the sulfated ash level of the lubricant composition is less than about 1.1 percent.

2. The lubricant composition of claim 1 wherein the sulfated ash level of the lubricant is less than about 1.0 percent.

3. The lubricant composition of claim 1 wherein the carboxylic functionalized polymer comprises a polyisobutylene of number average molecular weight of about 500 to about 10,000 bearing at least one succinic anhydride group.

4. The lubricant composition of claim 1 wherein the dispersant comprises the condensation product of a carboxylic functionalized polymer with an aromatic amine having multiple aromatic groups, at least one secondary or tertiary amino group, and at least one nitrogen functional group which provides linkage to the carboxylic functionalized polymer.

5. The lubricant composition of claim 1 wherein the amount of the dispersant of (b) is about 0.6 to about 6 percent by weight.

6. The lubricant composition of claim 1 wherein the overbased metal detergent comprises an overbased, carbonated, calcium or magnesium sulfonate, phenate, salicylate, saligenin, or salixarate detergent.

7. The lubricant composition of claim 1 wherein the overbased metal detergent comprises an overbased carbonated magnesium saligenin detergent.

8. The lubricant composition of claim 1 wherein the amount of the overbased metal detergent is about 1.3 to about 5 percent by weight.

9. The lubricant composition of claim 1 wherein the total amount of neutral metal salt component in the lubricant composition is at least about 1.0 percent.

10. A lubricant composition prepared by admixing the components of claim 1.

11. A method for lubricating an internal combustion engine, comprising supplying thereto the lubricant composition of claim 1.

12. The method of claim 11 wherein the internal combustion engine is a diesel engine.

13. The method of claim 11 wherein the internal combustion engine is a heavy-duty diesel engine.

14. The lubricant composition of claim 1 wherein the aromatic amine having at least 3 aromatic rings and being an anthranilic derivative is represented by the formula

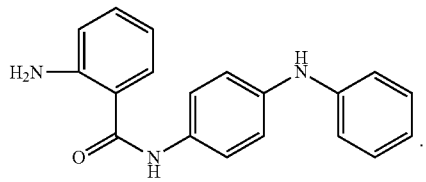

15. The lubricant composition of claim 1 wherein the dispersant is represented by the formula

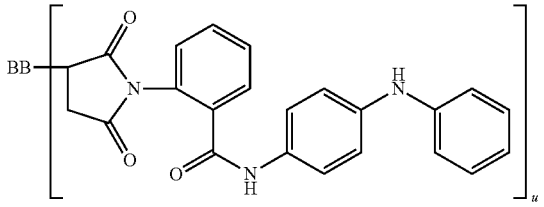
where BB represents a polymer backbone and u is a number of 1 to about 2000.
16. The lubricant composition of claim 1 wherein the dispersant is represented by the formula
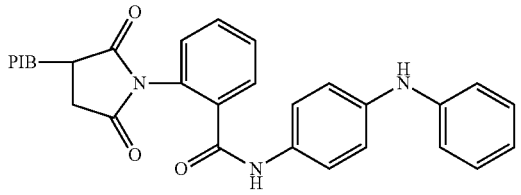
where PIB represents polyisobutylene.
* * * * *